United States Patent [19]

Crnkovic

[11] 4,194,490

[45] Mar. 25, 1980

[54] FIREPLACE THERMAL REFLECTOR APPARATUS

[76] Inventor: James J. Crnkovic, 70 Elmwood Ave., Glenolden, Pa. 19036

[21] Appl. No.: 822,902

[22] Filed: Aug. 8, 1977

[51] Int. Cl.² ..... F24B 1/18; F24C 15/22

[52] U.S. Cl. ..... 126/141; 126/39 M; 160/135

[58] Field of Search ..... 126/141, 39 M; 160/222, 160/135

[56] References Cited

U.S. PATENT DOCUMENTS

| | | | |
|---|---|---|---|
| 805,395 | 11/1905 | Webster et al. | 160/135 X |
| 1,490,274 | 4/1924 | Ivey | 126/274 |
| 1,770,775 | 7/1930 | Kleinpell | 160/135 X |
| 2,573,156 | 10/1951 | Meyer | 160/135 |
| 2,800,127 | 7/1957 | Flynn | 126/141 |
| 3,103,162 | 9/1963 | Scofield | 126/274 X |
| 3,994,275 | 11/1976 | Williams | 126/141 |
| 4,048,979 | 9/1977 | LaVasseur | 160/135 X |

*Primary Examiner*—Richard E. Gluck

*Attorney, Agent, or Firm*—Arthur E. Oaks; Robert S. Lipton

[57] ABSTRACT

A free standing thermal reflector apparatus is provided. When the apparatus is inserted into a fireplace and a fire is lit, heat from the fireplace is reflected into the room in which the fireplace is located. The apparatus includes reflector panels supported by a frame. To facilitate cleaning or replacement of the reflector panels, means are provided for their easy attachment to the frame of the apparatus. The reflector panels are made from highly polished stainless steel panels which may be glass coated to both increase the reflectivity of the reflector surface and to protect it from corrosion and oxidation.

2 Claims, 6 Drawing Figures

Fig. 1.
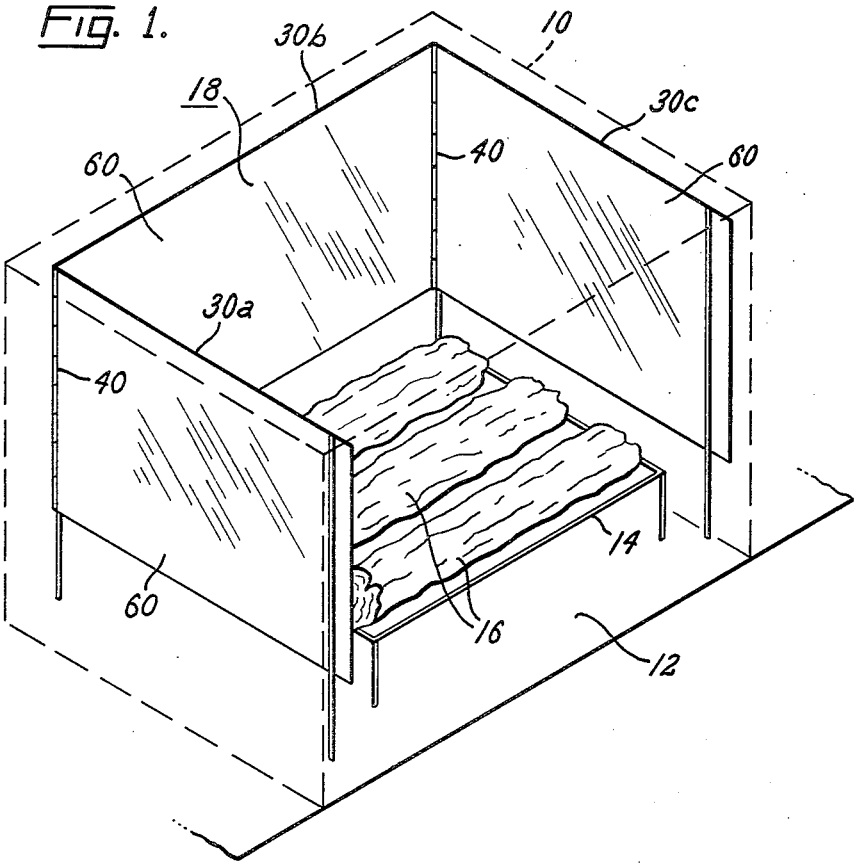
Fig. 2.
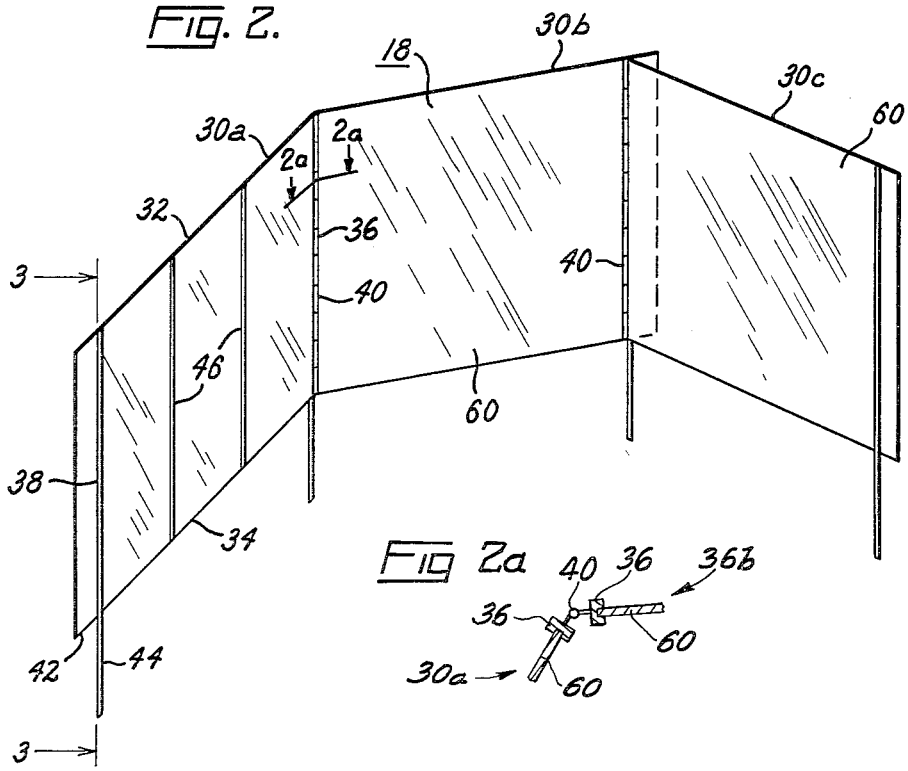
Fig 2a

FIREPLACE THERMAL REFLECTOR APPARATUS

BACKGROUND OF THE INVENTION

Field of the Invention

This invention relates to a fireplace reflector apparatus which is placed in the fireplace. It improves the effectiveness of the fire by reflecting heat energy into the room which would otherwise be lost up the chimney. A light weight frame which can be easily placed into and removed from a conventional fireplace is used to hold reflector panels. The panels themselves are supported on a set for tracks within the frame which both provide for easy removal for cleaning or replacement and a considerable degree of protection against buckling in service and can be glass coated for improved oxidation resistance.

Fireplace reflectors are well known in the prior art. While they are effective for their intended purpose they tend to present a number of practical difficulties when in use. Thus, prior art systems are typified by a large degree of permanency, that is, part or all of the basic structure is built into or physically attached to the fireplace walls in such a way that to insert a new reflector panel or remove old panels for cleaning or replacement can be quite laborious since it is necessary to perform some or all of the work inside the fireplace. This problem is compounded when the panels themselves are made from uncoated shiny metals such as polished aluminum. When heated, the metallic surfaces tend to become somewhat reactive with the hot products of combustion and to form various oxidation products of lower thermal reflectivity thereon. Furthermore, they often become soft enough to be relatively nonresistant to abrasion. These effects combined with any soot deposits which may occur during the burning cycle all tend to reduce fairly quickly the overall reflection capabilities and therefore the real utility and value of the system. When this occurs panel replacement or cleaning must be done.

Accordingly a need exists for an improved fireplace reflector apparatus which is free standing for easy insertion and removal from a fireplace. The apparatus must be able to conform to the contours of a particular fireplace. Further, there exists a need for means which will permit quick and easy insertion and removal of the reflector panels for cleaning or replacement. Additionally, a need exists for a panel structure which is capable of retaining a high degree of thermal reflectivity and abrasion resistance for relatively long periods of time.

SUMMARY OF THE INVENTION

The reflector apparatus consists of a light weight frame and several reflector panels for facilitating manufacturing, marketing, placement and use thereof. The frame itself is formed with a plurality of tracks, thereby allowing easy insertion or removal of the reflector panels. The panels are made from highly polished stainless steel which is itself highly resistant to oxidation and can be coated with a high melting point glass such as "Pyrex" for still further protection.

Accordingly, it is an object of the present invention to provide a fireplace reflector apparatus having improved reflection capabilities.

It is a further object of the present invention to provide a fireplace reflector apparatus having coated reflector panels for increasing the panel's reflectivity and usable life.

It is a further object of the present invention to provide a light weight fireplace apparatus which can be easily inserted and removed from a fireplace.

It is a further object of the present invention to provide a removable fireplace reflector apparatus which is adjustable so that it may match the contours of a fireplace.

It is still a further object of the present invention to provide a fireplace apparatus which includes means for permitting easy insertion and removal of the reflector panels from the apparatus.

Further objects of the invention will become apparent to those skilled in the art from examination of the following detailed description of the invention when taken in conjunction with the appended claims and figures.

BRIEF DESCRIPTION OF THE DRAWINGS

FIG. 1 is a perspective view of a conventional fireplace with a fireplace reflector apparatus of the present invention positioned therein.

FIG. 2 is a perspective view of te fireplace reflector apparatus of te present invention.

FIG. 2*a* is a perspective view taken along line 2*a* —2*a* shown in FIG. 2.

DETAILED DESCRIPTION OF THE INVENTION

Figure 3:
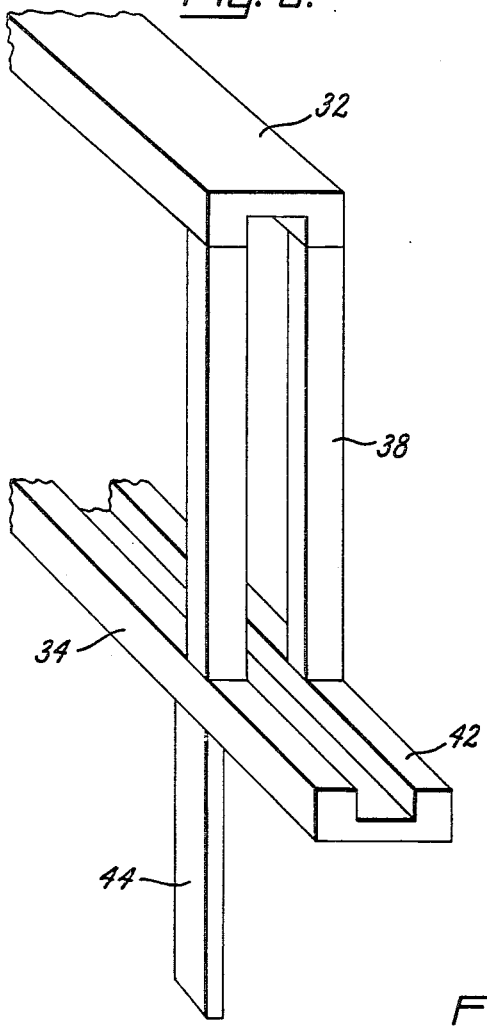
FIG. 3 is a view of the panel support system taken along line 3—3 shown in FIG. 2.

FIGS. 1, 2 and 2*a* show one embodiment of a fireplace reflector apparatus of the present invention. FIG. 1 shows the system in place within a conventional fireplace 10 which has a flat hearth 12 and a grate 14 which holds wood logs 16. The reflector apparatus 18 includes a set of three rectangular frames 30*a*, 30*b* and 30*c*, pivotally connected together, each holding a reflector panel 60. In use the frames 30*a* and 30*c* are positioned alongside the ends of the grate 14 and frame 30*b* is positioned behind the grate. In the preferred embodiment the individual frame sections are connected together by a plurality of hinges 40 so that the angle between sections 30*a*, 30*b* and 30*c* may be adjusted to follow the contours of the fireplace more closely.

Turning now to FIG. 2 we see the three sections in more detail. Depending on the fireplace width additional interior frame sections 30*b* can be used. As shown, the two side sections 30*a* and 30*c* of the frame are identical in structure. The center frame section 30*b* is basically similar to the side frame 30*a* but will generally be longer than the other two. Other minor differences between frames 30*a* and 30*b* will be discussed in detail below.

The reflector panels 60 are held in place in the frames 30, between upper grooved horizontal members 32 and lower grooved horizontal members 34. The grooves within these members face the interior of the frame and act as guides and supports for the reflector panels 60 which are inserted between them.

Frames 30*a* and 30*c* each include a vertical grooved member 36 at the end thereof which are hinged to a frame 30*b*. The opposite or forward end of frames 30*a* and 30*c* include vertical members 38 which have a vertical slot therebetween.

In properly positioning a panel 60 into frame 30*a* or 30*c* the panel is passed through the slot in the vertical member 38, engaging the grooves in the upper and lower horizontal members 32, until the panel finally engages the groove in the vertical member 36.

The rear or middle frame 30*b* also includes upper and lower horizontal groove members 32 and 34. One end of the frame 30*b* includes a vertical grooved member 36, while the opposite end includes a slotted vertical member 38. In inserting a reflector panel 60 into frame 30*b* the panel is passed through the slot in the vertical member 38, engaging the grooves in the upper and lower horizontal members 32, until the panel finally engages the groove in the vertical member 36.

The forward vertical members 38 of frames 30*a* and 30*c* extend to form legs 44. Of course, the legs 44 may be separate pieces which are joined to the lower horizontal member 34. In a like manner legs 44 form a part of, or are connected to the vertical members 36 and 38 of the rear of middle frame 30*b*. Frame 30*b* is pivotally connected to frame 30*a* and 30*c* through the use of hinges 40 which are connected to vertical members 36 of frames 30*a* and 30*b* at one end of 30*b* and connected to vertical members 38 and 36 of 30*b* and 30*c* at the other end of 30*b*.

The lower horizontal members 34 may be extended beyond the forward vertical members 38, as shown in FIG. 2. These extension members 42, as shown in FIG. 3, act as a guide for the insertion of the panels as they are being inserted into frames 30*a*, 30*b* and 30*c*. A more detailed view of the slot and frame structure along line 3—3 are shown in FIG. 3.

The frames may optionally include one or more vertical stiffeners 46 inserted between horizontal members 32 and 34 which can help preserve frame dimensional integrity and provide additional anti-buckling capabilities within the system. This modification is shown in frame 30*a* in FIG. 2.

Insofar as material of construction for the frames 30 are concerned, any thermally stable moderately heat resistant alloy such as martensitic carbon steel (approximately 0.5–0.6% carbon) or wrought iron will do. The individual frame sections can be readily assembled by conventional welding techniques or by the use of mechanical fasteners such as machine screws. The only requirement is te due care be taken to establish and maintain a high degree of alignment of the slots so that the reflector panels 60 can be easily inserted into frame 30 and slid into final position with a minimum of effort.

It is recognized that not all fireplaces have vertical backs. Often they have a curved or slanted back which acts to channel the smoke into the fireplace chimney (not shown). In this case a reflector such as is described above will not readily fit into the fireplace unless the back frame 30*b* is reduced in height so as to fit in underneath the non-vertical portion. When this is done the amount of heat reflected from this area is proportionately reduced.

Figure 4:
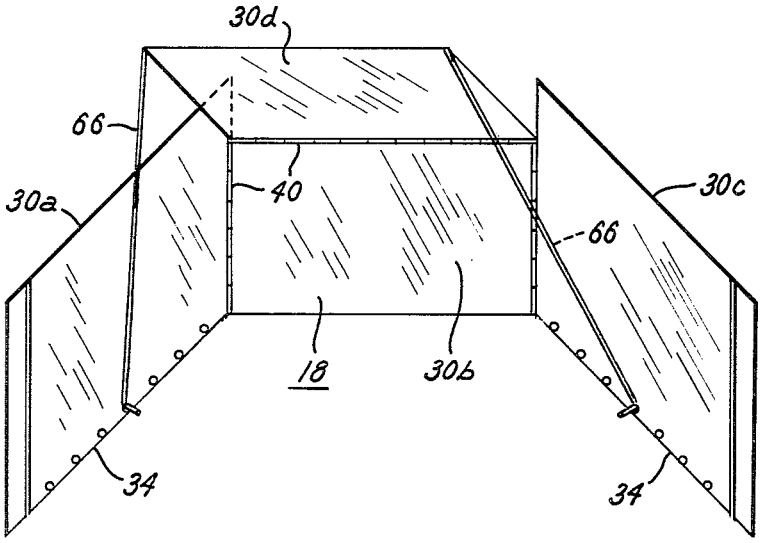
FIG. 4 is a view of an embodiment of the present invention.

To alleviate this condition a second embodiment of the present has a fourth rectangular frame 30*d* which is pivotally connected to frame 30*b* so as to follow the internal curve of a fireplace having such a condition. The general manner of construction will be similar to those of frame 30 except that legs 44 will be omitted. A set of hinged angular supports 66 will be used to establish a proper reflection angle and to support section 30*d*. In this embodiment the lower members 34 of frames 30*a* and 30*c* are modified to provide a series of slots or holes to act as resting points for these supports. One such modification is shown in FIG. 4.

The individual panels 60 are relatively simple in design. In the simplest embodiment they consist of rectangular or square sheets of highly polished relatively inexpensive stainless steel alloys such as one containing 18% chromium and 8% nickel and identified by the American Iron and Steel Institute as type 304. Such alloys are easily polished to the high level of reflection needed for most efficient operation. These alloys also provide excellent corrosion resistance in a fireplace environment at a moderate cost. This steel is also easily cleanable and does not react with conventional alkaline detergent solutions. It is also sufficiently scratch resistant so that mildly abrasive cleansers may also be used to remove more stubbornly adhering soot particles or other surface contaminants without significantly impairing the overall reflectivity of the panels.

Figure 5:
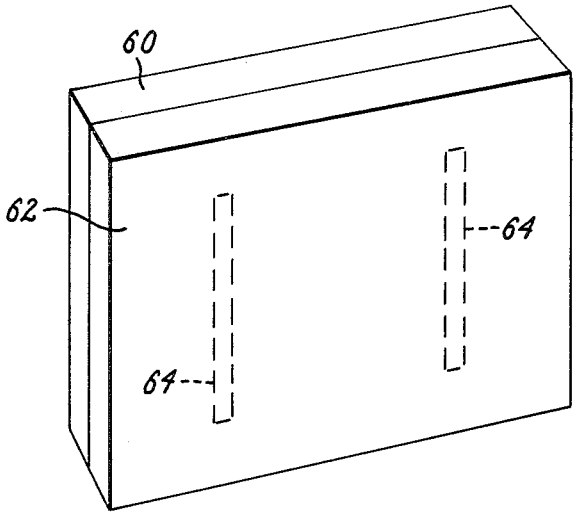
FIG. 5 is a view of a reflector panel utilized in the present invention.

In more severe environments the panels 60 may be further modified by coating to the reflecting surface a layer of heat resistant glass 62 such as Pyrex, as is shown in FIG. 5. This will increase the cost of the panel but it will provide it with an enhanced level of corrosion resistance, and more particularly abrasion resistance. These materials are resistant to heat and to alkaline detergents and other cleaning materials. The basic thickness of steel is not critical since heat reflection occurs from the surface only but should be thick enough so that the sheet will be sufficient strong not to buckle under its own weight or heat induced stress concentrations. For maximum economy and longevity, the panels can be polished and coated on both sides, or optionally, for high temperature strength, one or more stiffeners 64 may be welded to the rear of the sheet. As a practical matter such stiffeners should not be too thick as they will then impede passage of the panel through the channel created by upright members 38.

While the invention has now been described and illustrated with reference to certain preferred embodiments thereof those skilled in the art at various modifications, changes, ommissions and substitutions may be made without departing from the spirit of the invention. It is intended therefor that the invention be limited only by the scope of the following claims.

What is claimed is:

1. A free standing fireplace reflector apparatus for reflecting radiant heat energy into the room in which the fireplace is located, comprising:

a rear frame, including a pair of legs, receiving a first reflector panel; and a pair of side frames, pivotally connected to said rear frame so that the apparatus may be adjusted to fit into fireplaces having different side angles, each of said side frames having a leg connected thereto at the end opposite from said pivot; said frames receiving respectively a second and third reflector panel; each of said side frames and said rear frame including:

an upper horizontal grooved member and a lower horizontal grooved member receiving and slidably engaging one of said panels in said grooves; and a pair of vertical members connected to their respective upper and lower grooved members at the opposite ends thereof, wherein each of said pairs of vertical members includes one vertical member having a groove therein receiving an end of a reflector panel when said panel is positioned in said frame and one vertical member having a slot therein permitting said panel to pass therethrough so that said panel is properly positioned to slide between the upper and lower grooved members into the vertical grooved member in each of said frames.

2. The apparatus of claim 1 wherein at one end of each of said frames said lower horizontal member extends beyond said vertical member having a slot, for supporting and guiding said panel when said panel is being removed or inserted into said frame.

* * * * *